US005284337A

United States Patent [19]

Ettischer et al.

[11] Patent Number: 5,284,337

[45] Date of Patent: Feb. 8, 1994

[54] SHEET DEPOSITING DEVICE

[75] Inventors: Helmut Ettischer, Ostifildern; Werner Hess, Stuttgart, both of Fed. Rep. of Germany

[73] Assignee: Eastman Kodak Company, Rochester, N.Y.

[21] Appl. No.: 988,497

[22] Filed: Dec. 10, 1992

[30] Foreign Application Priority Data

Jan. 17, 1992 [DE] Fed. Rep. of Germany ..... 4201076

[51] Int. Cl.[5] ..... B65H 31/00

[52] U.S. Cl. ..... 271/220; 271/145; 271/207; 211/51

[58] Field of Search ..... 211/51, 53; 271/145, 271/177, 207, 220, 221, 222; 355/322

[56] References Cited

U.S. PATENT DOCUMENTS 4,143,960 3/1979 Tracy ..... 355/3 R
4,444,494 4/1984 Koyama et al. ..... 355/75
4,882,603 11/1989 Sakata ..... 355/75
4,890,825 1/1990 McCormick et al. ..... 271/188
5,044,623 9/1991 Munz et al. ..... 271/220

FOREIGN PATENT DOCUMENTS 32995 2/1911 Norway ..... 211/51

*Primary Examiner*—H. Grant Skaggs
*Attorney, Agent, or Firm*—Lawrence P. Kessler

[57] ABSTRACT

A sheet depositing device comprises a depositing surface (2) limited by a front abutment (8). Above the depositing surface (2), a cover (4, 5) is pivotable about a journal (7). A hold-down element (6) provided on the cover (4, 5) is associated with the sheet stack (3) to be formed. It has a front end (6a) which rests under the action of gravity on sheet stack (3). Hold-down element (6) is connected with the cover (4, 5) via an engagement member (14) such that when the cover (4, 5) is opened, it is pivoted towards the cover so that the stacking area can be freely inspected and access is not obstructed when the cover (4, 5) is open. At the beginning of the opening movement of cover (4, 5) the front end (6a) of the hold-down element is caused by the engagement member (14) to move away from the abutment (8).

3 Claims, 3 Drawing Sheets

SHEET DEPOSITING DEVICE

BACKGROUND OF THE INVENTION

This invention relates in general to a device for depositing sheets which are individually fed to a collecting tray where they are collected one on top of the other in a stack, and in particular, to a sheet depositing device whose collecting tray has a depositing surface and an abutment serving for end-side alignment of the sheets, such device also having a pivotable cover which is associated with such collecting tray and on which a sheet influencing mechanism is arranged which rests on the upper surface of the sheet stack.

The invention also relates to a device for depositing sheets which are individually fed to a collecting tray where they are collected one on top of the other in a stack, and in particular, copy sheets fed from a copier, whose collecting tray has a depositing surface and an abutment serving for end-side alignment of such sheets, such device also having a pivotable cover which is associated with such collecting tray and on which a hold-down element is pivotably mounted which is hinged to the cover with its one end facing away from the abutment and with its other end resting on the upper surface of the sheet stack in the area of the abutment.

A sheet depositing device, such as shown for example in U.S. Pat. No. 4,890,825, comprises a pivotable cover which is arranged above the upper surface of the sheet stack and with the lower side of which a hold-down element is pivotably connected which rests on the upper surface of the stack when the cover is closed. The cover which also forms the upper surface of the device is hinged in the sheet feeding direction and can be pivoted over an opening angle of 90°. If there is a paper jam, therefore, the cover of this known device can be opened wide enough to give access to the depositing area because the easily damageable hold-down element can also be pivoted aside by a large angle. However, if a depositing device of that type is to be integrated into an apparatus in which a plurality of operations such as folding, collecting of sheets in stacks, stapling and depositing are to be carried out at the same time, it may occupy too much space in the interior of the apparatus so that access to the depositing device is rendered difficult.

SUMMARY OF THE INVENTION

It is the object of the invention to provide a sheet depositing device which, in spite of lack of space, the cover can be handled without problem and free inspection of, and access to the depositing area is ensured. According to the invention, this object is attained in that when the cover is opened, a sheet influencing member can be moved from a lower position associated with the upper surface of the sheet stack to a raised position in which it rests against the lower side of the cover. Further, when the cover is opened, a hold-down element can be moved from a lower position associated with the upper surface of the sheet stack to a raised position in which it rests against the lower side of the cover. The sheet influencing member and the hold-down element respectively is positively guided such that its end which faces the abutment and a stapling device arranged in that area and rests on the upper surface of the sheet stack is moved away from the stapling device in opposition to the sheet-feeding direction at the beginning of the opening movement of the cover.

The cover is pivotably mounted such that it can be opened in the sheet-feeding direction so that the depositing surface is accessible from the direction of the end-side abutment and the stapling device, and both the depositing area and the stapling device can be inspected and jams eliminated. The cover consists of a cover portion including a handle and a guide element carrying the hold-down element. Both parts are pivotable about a common journal, with the end of the hold-down element, which rests on the upper surface of the sheet stack, being held in engagement with the cover portion via an engagement member which extends through the guide element. Since the cover portion and the guide element are movable relative to each other, it is possible in an advantageous manner for the hold-down element to be placed into contact with the guide element during pivoting of the cover portion before the collecting tray is actually opened so that when the cover is open the hold-down element no longer obstructs the access area. The engagement member is positively guided such that at the beginning of the opening movement of the cover portion it carries out a pivotal movement by which the end of the hold-down element, which rests on the upper surface of the stack, is moved away from the stapling device in opposition to the sheet-feeding direction so that the retracted hold-down element cannot strike against the stapling device when pivoting upwards.

As a further aspect of the invention, a one-part cover is used to which a rigid, two-armed hold-down element is hinged one arm of which rests on the upper surface of the stack. The other arm of the hold-down element is urged by a spring, the arrangement being such that when the cover is pivoted open, the spring becomes operative for moving the hold-down element into contact with the cover whereas the spring is separated from the hold-down element when the cover is closed so that the hold-down element then rests on the upper surface of the stack solely under the action of gravity. The journal of the hold-down element is positively guided in stationary guide grooves such that the hold-down element is moved away from the stapling device in opposition to the sheet-feeding direction when the cover starts its opening movement.

The arrangement and design of the sheet influencing means and hold-down element respectively according to the invention results in the advantage of this means and holder respectively not obstructing the depositing area when the cover is open so that no damage or interference occurs when the operator has to have access to said area. Thanks to the design according to the invention the hold-down element can moreover be placed in a functionally suitable manner as closely as possible to the stapling device which extends into the depositing area of the sheets, without opening and closing of the cover being hindered thereby. Moreover, since the invention provides that the hold-down element is placed on the cover, the opening angle required for free access can be kept small and adapted to the available space.

The invention, and its objects and advantages, will become more apparent in the detailed description of the preferred embodiments presented below.

BRIEF DESCRIPTION OF THE DRAWINGS

Other features and advantages can be inferred from the description of embodiments of the invention illustrated in the drawings and from the subclaims. The drawings show schematically that:

DESCRIPTION OF THE PREFERRED EMBODIMENTS

Figure 1:
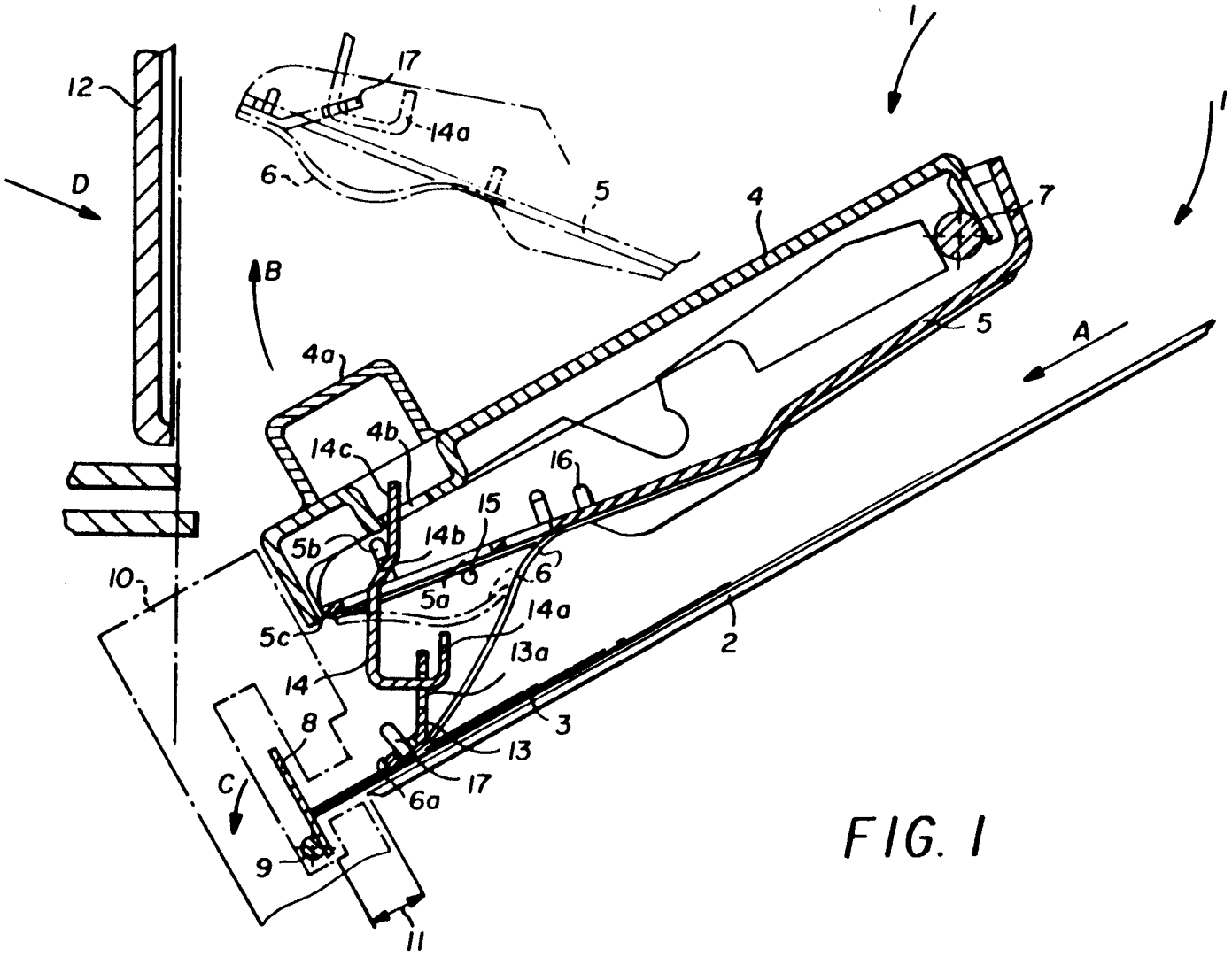
FIG. 1 is a side elevational view, in cross-section, of the sheet depositing device.

The sheet depositing device according to the invention is arranged on a finisher of a known type (not illustrated) wherein individually supplied sheets, in particular copy sheets fed from a copier, are collected in a collecting tray 1 as illustrated in FIG. 1 and stapled in sets by a stapling device 10 (shown in phantom). Of the finisher, which is connected with a copier (not illustrated), only those components are shown as are necessary to understand the invention.

The sheets fed substantially under the action of gravity into the collecting tray 1, which is inclined in the sheet-feeding direction "A", are deposited on a depositing surface 2 to form a sheet stack 3. In the lower part of collecting tray 1, the incoming sheets move into the range of action of an aligning device of a known type (not illustrated), including a driven aligning wheel which shifts the individual sheets in a known manner (not illustrated) into contact with a lateral abutment (not illustrated) as well as against a front abutment 8. The front abutment 8 is connected to a stationarily mounted shaft 9 and pivotable in the direction of the arrow "C" by a driving means (not illustrated). Depositing surface 2 is spaced from the front abutment 8 by a distance which provides a free space 11 which allows a stapling head of a stapling device 10 to move along said space 11 directly below depositing surface 2 into any stapling position desired.

Stapling device 10, which is of a type known per se and not illustrated in detail, includes a stapling head for driving in the staples and an oppositely arranged anvil for bending and clinching the staple ends driven through a sheet stack 3. The stapling device 10 is movable in a manner (not illustrated) along guide means to assume various stapling positions and is driven via a profiled shaft (not illustrated) which is permanently held in positive engagement so that the stapling device driven by a single driven unit is immediately ready to function in any stapling position selected.

Above depositing surface 2, a two-part cover is arranged which consists of an upper cover portion 4 and a sheet influencing lower guide element 5, which are mounted for pivotal movement about a common journal 7. Cover portion 4 is provided with a handle **4*a* for opening of the cover 4 and 5. In the closing position illustrated in FIG. 1, guide element 5 rests against a stationary abutment pin 15 while cover portion 4 rests against guide element 5. At the lower side of guide element 5, which faces the depositing surface 2, the rear end of a flexible hold-down element 6 is mounted by means of plug connections 16 which are not illustrated in detail. The front end 6*a* of hold-down element 6 rests on the sheet stack 3 under the action of gravity, its weight being relatively low, however, so that the sheets can be safely conveyed to, and held in contact with the front abutment 8**.

Above the front end **6*a* of hold-down element 6, an intermediate member 13 is mounted by means of plug connections 17. It is provided with an opening 13*a* adapted for positive engagement with an engagement member 14. The engagement member which is received in the opening 13*a* of intermediate member 13 with a hook-shaped portion 14*a* provided at one of its ends, extends through a recess 5*a* of guide element 5. The other end of engagement member 14 positively engages a slot 4*b* of the upper cover portion 4 so that cover portion 4 and hold-down element 6** are positively connected.

End **14*c* of engagement member 14, which is held in engagement with cover portion 4, is T-shaped and broad enough to be insertable in a position turned by 90° into a slot 4*b* of cover portion 4. When the engagement member 14 thus inserted is turned by 90° to assume its position illustrated in FIG. 1, it is positively connected with the upper cover portion 4. Engagement member 14 moreover includes an inclined surface 14*b* which is associated with a projection 5*b* arranged on guide element 5. There are two identically shaped engagement members 14 which are spaced from each other (only one is illustrated) and which each engage as described the hold-down element 6 which extends transversely to the sheet-feeding direction "A" so that the flexible hold-down element 6** can be raised or lowered uniformly over its entire width.

As can be inferred from FIG. 1, stapling device 10 is arranged and designed such that it extends in opposition to the direction of the arrow "A" into the depositing area of the sheets so that it can obstruct the path of movement of hold-down element 6. This is due to the fact that the front end **6*a* of hold-down element 6 should on the one hand extend as far as possible into the stapling area which is to remain clear while on the other hand the journal 7 is arranged at a relatively great distance from the depositing surface 2 so that the sheet collecting area is kept clear. This results in an excessive turning radius of hold-down element 6 so that when cover 4, 5 is opened, hold-down element 6 would strike with its front end 6*a* against stapling device 10**.

In order to reliably prevent the hold-down element 6 from being interfered with or damaged, it is controlled at the beginning of the opening movement of the upper cover 4 such that its front end **6*a* is first moved in opposition to the direction of arrow "A" before the actual opening operation is started. If a jab is to be eliminated in the collecting tray 1 and the cover 4, 5 to be pivoted open for that purpose, a door 12 is opened which gives access to collecting tray 1. Subsequently, the upper cover portion 4 is pivoted in the direction of the arrow "B" by means of its handle 4*a*. The engagement members 14 which are positively engaged are raised and, via their inclined surfaces 14*b*, which rest against the projections 5*b* of guide element 5 still in its initial position, are pivoted counterclockwise. The hook-shaped portion 14*a* of engagement member 14 engages the intermediate member 13 to pivot it in the same direction whereby the front end 6*a* of hold-down element 6 is moved in opposition to the direction of the arrow "A". During further raising of cover portion 4, hold-down element 6 is placed against the lower side of guide element 5** such that it assumes the curved position indicated in dash-dotted lines in FIG. 1. Recess 5*a* in guide element 5 is dimensioned such that the engagement member 14, 14*a* and the intermediate member 13 can be received by it without problem.

As soon as hold-down element 6 has come to rest against guide element 5, the guide element is taken along during further movement of cover portion 4 and also pivots in the direction of the arrow "B" so that the depositing area is completely cleared. Cover portion 4 is subsequently moved to an upper end position (not illustrated) in which it is locked. In the open position, guide element 5 and the hold-down element 6 resting against it assume the upper position illustrated in dash-dotted lines in FIG. 1 in which inspection of, and free access to the depositing area of collecting tray 1 are possible without problem in the direction of the arrow "D" because hold-down element 6 no longer obstructs the access area. Any jam in the depositing area or in the area of stapling device 10 can thus be easily detected and promptly cleared.

After the jam has been cleared, cover portion 4 is lowered in opposition to the direction of the arrow "B", hold-down element 6 remaining for the time being in its position in contact with guide element 5 so that the front end 6*a* of hold-down element 6 can freely pivot past stapling device 10. As soon as guide element 5 abuts abutment pin 15, engagement member 14 lowers the hold-down element 6 until it rests on sheet stack 3. As a result the inclined surfaces 14*b* are moved away from the projections 5*b* so that the engagement member 14 pivots clockwise and moves the front end 6*a* of hold-down element 6 once again closely to the stapling device 10. Cover portion 4 held in its closed position as shown in FIG. 1 rests against guide element 5. Subsequently door 12 of collecting tray 1 is closed again.

Further embodiments of the device will be described with reference to FIGS. 2 and 3 and 4 and 5 respectively in which the same reference numerals are used for identical components.

Figure 2:
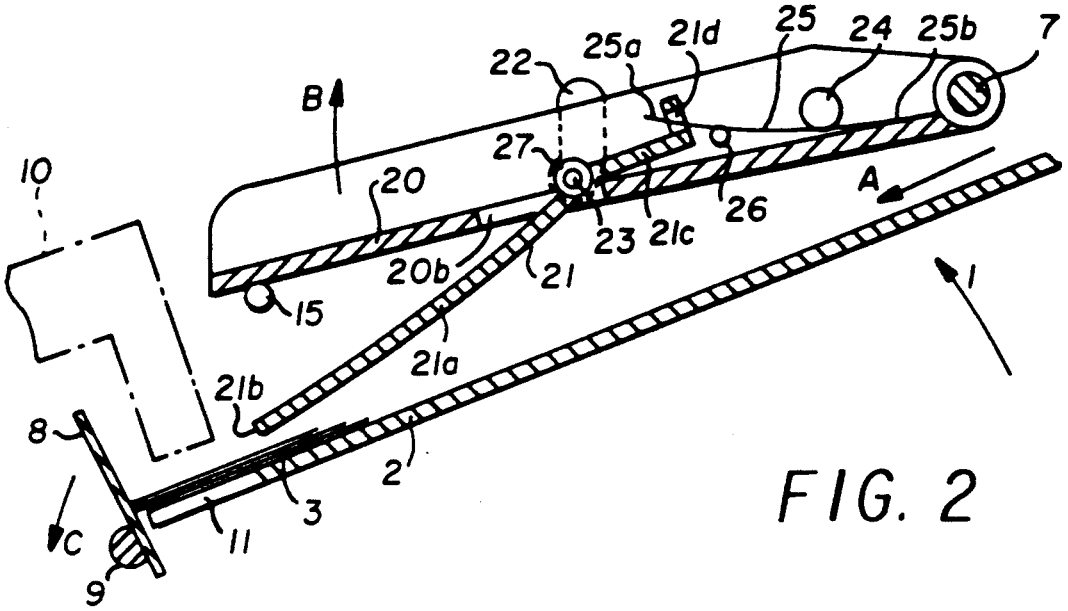
FIG. 2 is a side elevational view of a further embodiment of the sheet depositing device, in its closed condition.
Figure 3:
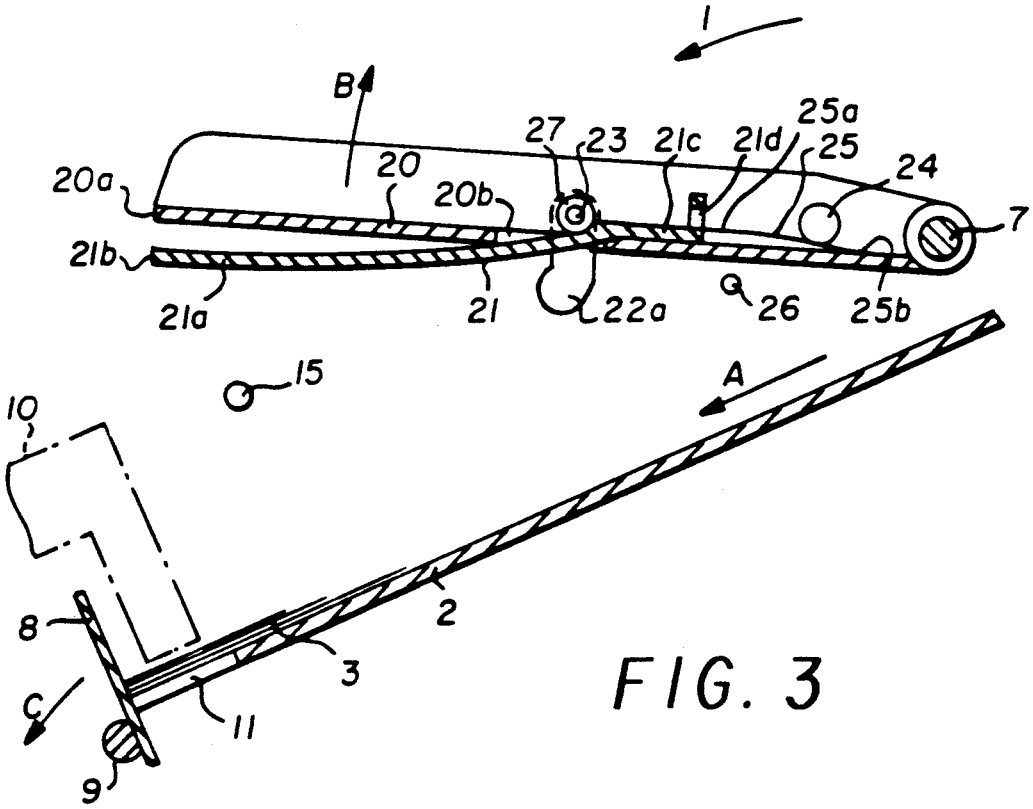
FIG. 3 is a side elevational view of sheet depositing device according to FIG. 2, in its open condition.

FIGS. 2 and 3 show a one-part cover 20, pivotally mounted about journal 7 above the depositing surface 2, which is inclined in the sheet-feeding direction "A". In its closed position depicted in FIG. 2, the cover rests against abutment pin 15. A rigid, two-armed hold-down element 21 is mounted on cover 20 so as to be pivotable about a journal 23 which is shiftably mounted on cover 20 in a manner not illustrated. Journal 23 includes on each of its two ends a rotatably mounted roller 27 which is restrained from shifting laterally and received in a stationary guide groove 22 arranged outside the depositing area.

The guide grooves 22 each have an upper section arranged radially with respect to journal 7 and, contiguous therewith, a lower section 22*a* which is bent off in the direction towards stapling device 10. Hold-down element 21 extends with a first arm 21*a* through a recess 20*b* of cover 20 and under the action of gravity rests on sheet stack 3, with the free end 21*b* of said arm also extending directly up to the stapling area of stapling device 10 which has to be kept clear. A second arm 21*c* of hold-down element 21 is arranged above cover 20 and includes a recess 21*d* in which a first arm 25*a* of a leg spring 25 is received. Leg spring 25 is mounted on a pin 24 of cover 20 and with its second arm 25*b* is supported on cover 20. A stationary pin 26 is arranged within the path of pivotal movement of the first arm 25*a* of leg spring 25.

The device functions as follows:

In the closing position of cover 20 illustrated in FIG. 2, the front end 21*b* of hold-down element 21 extends so far into the range of operation of stapling device 10 that it would strike against the stapling device during opening of cover 20. In the case of the device according to FIGS. 2 and 3, such contact is avoided in that at the beginning of the opening movement of cover 20 in the direction of the arrow "B", the rollers 27 are guided along the bent-off sections 22*a* in opposition to the direction of the arrow "A". This causes journal 23 of hold-down element 21 to slide back by a distance great enough to allow the front end 21*b* to freely pivot past stapling device 10. During the opening of cover 20 and after the rollers 27 have entered the radial section of the guide grooves 22, the first arm 25*a* of leg spring 25 leaves pin 26 and contacts the second arm 21*c* of hold-down element 21 whereby the hold-down element is spring-urged to pivot clockwise. The hold-down element 21 pivots into contact with cover 20 (see FIG. 3) so that its first arm 21*a* does no longer obstruct the access area and a jam can be cleared without problem.

When cover 20 is closed, the sequence of movements is reversed, i.e. the hold-down element 21 is only shifted forward in the direction of the arrow "A" at the end of the closing movement in that the rollers 27 enter the bent-off portion 22*a*. During the closing, movement arm 25*a* of leg spring 25 is lifted by pin 26 from the second arm 21*c* of hold-down element 21 so that arm 21*a* of hold-down element 21 is once again lowered onto sheet stack 3 under the action of gravity. Instead of using rollers 27, cylindrical projections (not illustrated) may be provided at the ends of journal 23, such projections sliding positively in the guide grooves 22.

Figure 4:
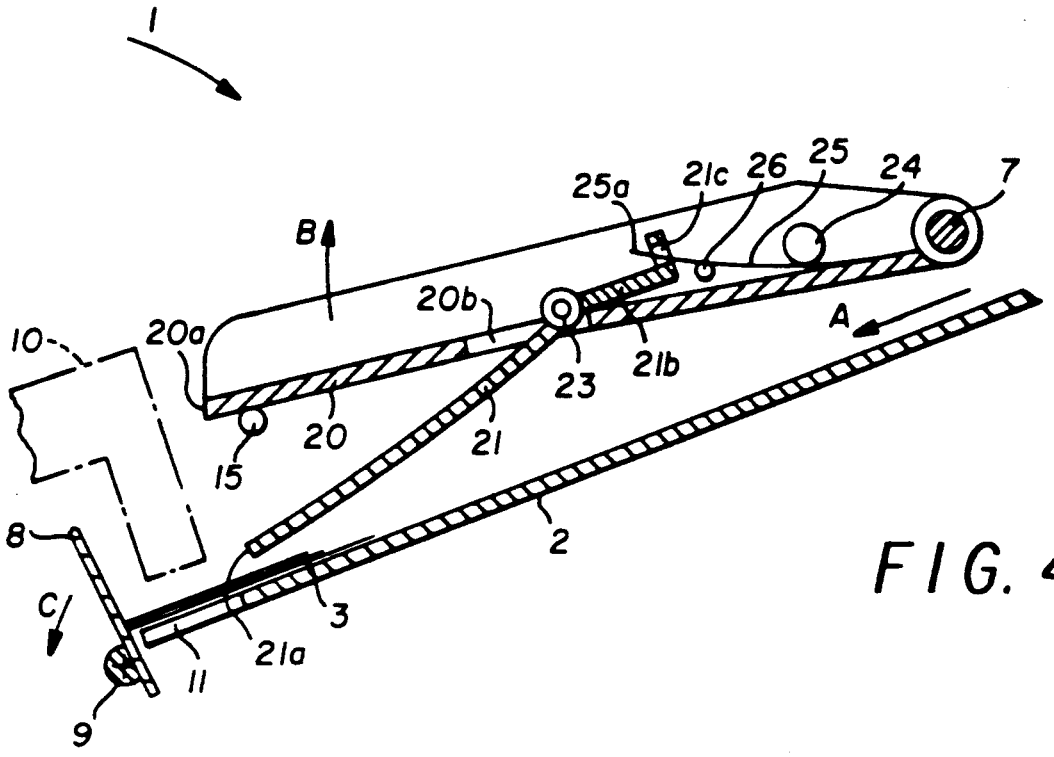
FIG. 4 is a side elevational view, in cross-section, of a further embodiment of the invention, in its closed condition.
Figure 5:
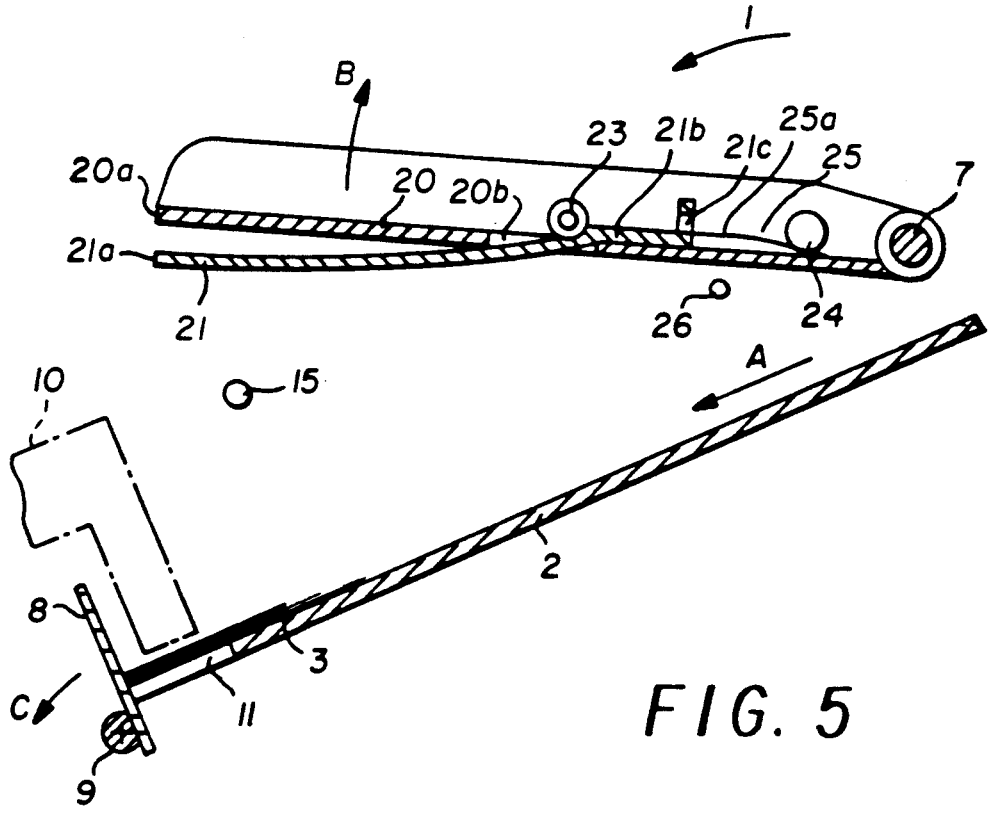
FIG. 5 is a side elevational view of the sheet depositing device according to FIG. 4, in its open condition.

In contrast to the embodiment illustrated in FIGS. 2 and 3, the device may also have a more basic design if the spatial conditions in the area of the stapling device are favorable enough to render a withdrawal of hold-down element 21 in opposition to the direction of the arrow "A" unnecessary. Such a basic device is illustrated in FIGS. 4 and 5 which with respect to its other constructional and functional features corresponds to the device described in connection with FIGS. 2 and 3. In the case of the device according to FIGS. 4 and 5, the hold-down element 21 is mounted for pivotal movement about a journal 23 stationarily arranged on cover 20. When cover 20 is raised from the closing position shown in FIG. 4 in which hold-down element 21 rests on sheet stack 3 under the action of gravity, leg spring 25 becomes operative to urge the hold-down element 21 into contact with cover portion 20. Free inspection of, and access to the depositing and stapling area is thus possible in this case, too, because hold-down element 21 is held in its raised position. The pivoting of hold-down element 6 and 21 respectively into contact with the guide element 5 and the cover 20 respectively results in an advantageous manner in that the path of pivotal movement of the guide element 5 and the cover 20 respectively, which is needed to enable the operator to clear jams, may be smaller so that the depositing device may also be used in devices where there is a lack of space.

In contrast to the embodiments illustrated, different or additional components or sheet influencing means not illustrated such as stack height sensors, sheet aligning wheels and the like which are arranged on the cover 4, 5 and 20 respectively and extend into the depositing area can be pivoted to rest against cover 4, 5 and 20 respectively in the manner described in order to achieve the aforementioned advantage of free access to such area. It is also possible for the hold-down element 6 and 21 respectively and/or other components or sheet influencing means to be moved into their position on the cover 4, 5 and 20 respectively by an electromagnetically controlled operation (not illustrated). In contrast to the embodiments shown in FIGS. 2 to 5 in which the depositing surface 2 is inclined in the sheet-feeding direction "A" in order that the incoming sheets can be moved in the direction of the arrow "A" under the action of gravity, the depositing surface 2 of these devices may also be arranged horizontally if this is feasible by the arrangement of suitable transport means and if it appears useful. The advantageous mode of operation of the devices which is due to the pivoting of the hold-down element 21 onto cover 20 is not affected thereby.

The invention has been described in detail with particular reference to preferred embodiments thereof, but it will be understood that variations and modifications can be effected within the spirit and scope of the invention as set forth in the claims.

We claim:

1. A sheet collecting tray assembly comprising:

a sheet collecting tray having an inclined surface, having a lower end and an abutment at the lower end for receiving sheets one at a time and for stacking the sheets on the inclined surface with edges of the sheets engaging the abutment, a cover pivotally mounted adjacent an upper end of the inclined surface extending toward the abutment, and pivotable for movement between positions covering and uncovering the inclined surface, a sheet hold-down member pivotally mounted to the cover between the pivotal mounting of the cover and the abutment, said sheet hold-down member extending toward the abutment to rest against a top sheet in the stack when the cover is in its covering position, and means for pivoting the hold-down member toward the cover in response to movement of the cover toward its uncovering position to make a stack on the inclined surface accessible when the cover is moved to its uncovering position.

2. The sheet collecting tray assembly according to claim 1, wherein said cover includes an engagement member coupled to an end of the hold-down member which end engages the stack, which engagement member is movable between a position holding said hold-down member against the stack when said cover is in the covering position and a position holding said hold down member away from the stack and toward the cover when said cover is in its uncovering position.

3. The sheet collecting tray assembly according to claim 1, wherein said hold-down member is a substantially rigid, two-armed element pivotally hinged to said cover, a first arm of said hold-down element resting, under the action of gravity, with a free end on the upper surface of a stack on the inclined surface, and wherein said assembly includes a leg spring mounted on the cover and engaging a second arm of said hold-down element to urge said hold-down element away from said stack and a stationary abutment arranged in the path of movement of the leg spring to prevent the leg spring from urging the hold-down member away from the stack when said cover is in its covering position and means for moving the abutment to a position in which it does not prevent the leg spring from urging the hold-down member away from the stack when the cover is in its uncovering position.

* * * * *